US008398081B1

(12) United States Patent
Girolmo et al.

(10) Patent No.: US 8,398,081 B1
(45) Date of Patent: Mar. 19, 2013

(54) COMBINATION DICE AND BOARD GAME AND ASSOCIATED METHOD

(76) Inventors: Daniel Girolmo, Dulzura, CA (US); Claire Girolmo, Dulzura, CA (US)

( * ) Notice: Subject to any disclaimer, the term of this patent is extended or adjusted under 35 U.S.C. 154(b) by 135 days.

(21) Appl. No.: 13/008,749

(22) Filed: Jan. 18, 2011

Related U.S. Application Data

(63) Continuation-in-part of application No. 11/880,223, filed on Jul. 20, 2007, now abandoned.

(51) Int. Cl.
*A63F 3/08* (2006.01)

(52) U.S. Cl. ..... 273/268

(58) Field of Classification Search ..... 273/268, 273/146; 463/22
See application file for complete search history.

(56) References Cited

U.S. PATENT DOCUMENTS

| | | | | | |
|---|---|---|---|---|---|
| 3,977,677 | A * | 8/1976 | Magiera | 273/255 |
| 3,977,679 | A * | 8/1976 | Magiera | 273/249 |
| 4,070,026 | A * | 1/1978 | Cambardella | 273/254 |
| 4,506,890 | A * | 3/1985 | Murry | 463/22 |
| 4,648,602 | A * | 3/1987 | Maroney | 273/146 |
| 4,834,386 | A * | 5/1989 | Rosenthal et al. | 273/146 |
| 4,961,581 | A * | 10/1990 | Barnes et al. | 273/236 |
| 5,342,059 | A * | 8/1994 | Briem et al. | 273/277 |
| 5,364,101 | A * | 11/1994 | Spooner et al. | 273/146 |
| 5,607,159 | A * | 3/1997 | Bryson | 273/243 |
| 5,649,704 | A * | 7/1997 | Dobbin | 273/268 |
| 6,315,293 | B1 * | 11/2001 | Bush | 273/244.1 |
| 6,605,001 | B1 * | 8/2003 | Tarantino | 463/22 |
| 6,656,047 | B1 * | 12/2003 | Tarantino et al. | 463/22 |
| 6,729,619 | B2 * | 5/2004 | Yu et al. | 273/146 |
| 7,331,860 | B2 * | 2/2008 | Herrmann et al. | 463/16 |
| 7,494,124 | B2 * | 2/2009 | Hole | 273/146 |
| 2002/0160827 | A1 * | 10/2002 | Slomiany et al. | 463/16 |
| 2002/0198044 | A1 * | 12/2002 | Walker et al. | 463/25 |
| 2003/0054879 | A1 * | 3/2003 | Schneier et al. | 463/29 |
| 2003/0085515 | A1 * | 5/2003 | Yu et al. | 273/146 |
| 2005/0116411 | A1 * | 6/2005 | Herrmann et al. | 273/146 |
| 2006/0097447 | A1 * | 5/2006 | Tucker | 273/146 |
| 2008/0203657 | A1 * | 8/2008 | Hole | 273/146 |
| 2010/0078885 | A1 * | 4/2010 | Thielbar | 273/146 |
| 2011/0300921 | A1 * | 12/2011 | Peterson | 463/22 |
| 2011/0309578 | A1 * | 12/2011 | Lambert et al. | 273/274 |

* cited by examiner

*Primary Examiner* — Melba Bumgarner
*Assistant Examiner* — Seng H Lim

(57) ABSTRACT

A combination dice and board game includes a substantially square-shaped arena. Such an arena includes a planar base member and a plurality of vertical walls monolithically formed with such a base member. The game further includes a mechanism for scoring points. Such a point scoring mechanism is employed within an interior area of the arena and includes a plurality of pretty dice. The point scoring mechanism further includes a plurality of fancy dice coextensively shaped with the plurality of pretty dice, a third plurality of traditional dice, and a dice cup. The game apparatus further includes a mechanism for calculating the points, a mechanism for recording the points, and a mechanism for determining how to score the points. Such a score determining mechanism includes a manual of rules. Such a manual describes steps necessary to score points during operating conditions.

12 Claims, 6 Drawing Sheets

COMBINATION DICE AND BOARD GAME AND ASSOCIATED METHOD

CROSS REFERENCE TO RELATED APPLICATIONS

This application is a continuation-in-part application of U.S. patent application Ser. No. 11/880,223, filed Apr. 20, 2007, which claims the benefit of U.S. Provisional Application No. 60/807,892, filed Jul. 20, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to board games and, more particularly, to a combination dice and board game for providing challenging entertainment for a plurality of users.

2. Prior Art

For centuries, games have been a favorite pastime of adults as well as children. In fact, the earliest form of the familiar checkers can be traced to the Egyptians as early as 600 B.C. Other popular games, such as backgammon, chess, Scrabble®, and Monopoly®, have also provided years of fun and excitement for families and friends. Traditional board, card, and trivia games continue to flourish despite the foreboding in recent years that these would suffer in popularity from the onslaught of computer, video and handheld forms of play. Culture-watchers further stipulate that in these especially trying times, with terrorism looming and an uncertain economy, games encourage relaxed, comfortable social interchange. Proving that nothing can equate the interaction of people in a common recreational pursuit, these tried-and-true diversions are certain to be around for a long time to come.

U.S. Pat. No. 4,902,021 to Burroughs discloses a checker and dice board game that introduces a new method of checker playing whereby numbered checkers correspond with numbers on a pair of thrown dice. The dice, when thrown, will determine which checkers qualify to be moved. Unfortunately, this prior art example is merely a variation of an already popular game.

U.S. Pat. No. 7,195,558 to Perez discloses a game of reasoning that includes a triangular game board. Players are given a pre-defined time limit to respond to questions based on scenarios likely to be encountered by the game's preferred teenage players. Points and penalties correspond to the selected responses. By correctly responding, players advance from a base of the game board to a zenith thereof. Once all players of a participating team reach the zenith, that team is declared the winner. Responses to questions are input by means of a game pad. The game board is formed of independent blocks stacked in a triangular shape divided into two sides. Each block includes at least one viewable face sectioned into equal parts corresponding to the number of team players. The sections include means of unique color illumination such that the progress of each player can be monitored. The game is also playable in a computer environment. Unfortunately, this prior art example is designed primarily for teenagers and therefore is not appropriate for younger or older players.

U.S. Pat. No. 7,080,838 to Cohen discloses a uniquely entertaining board game where the total value of two dice of different colors or with a recognizable difference, one designating possible single value numerals, (1 through 6), and the other values of possible numerals, times ten, (10 through 60), are added together, creating a strictly unique sequence of thirty-six numerals. The object of the game is to have a fixed or moveable designated numeral to determine the beating of the ladder by the player rolling the dice with a score of the designated numeral or greater. The other players bet that the score will be either higher or lower than the designated number. A bank pays the winnings and takes in the losses. Unfortunately, this prior art example is not designed to be played strategically.

Accordingly, the present invention is disclosed in order to overcome the above-noted shortcomings. The present invention satisfies such a need by providing and apparatus that is convenient and easy to use, lightweight yet durable in design, and designed for providing challenging entertainment for a plurality of users. The combination dice and board game offers a user hours of competitive and challenging fun. The game requires both strategy and skill and provides a user a means of stimulating their mind while honing their thought process. The present invention is simple to use, inexpensive, and designed for many years of repeated use.

BRIEF SUMMARY OF THE INVENTION

In view of the foregoing background, it is therefore an object of the present invention to provide a means for providing challenging entertainment for a plurality of users. These and other objects, features, and advantages of the invention are provided by a combination dice and board game.

A combination dice and board game includes a substantially square-shaped arena. Such an arena includes a planar base member and a plurality of vertical walls monolithically formed with such a base member. Such walls are effectively located along an outer perimeter of the base member and extend upwardly and away therefrom such that the base member and the walls respectively cooperate to form a hollow interior defined by the base member and the walls respectively. Each of the walls has an equal height. The arena further includes a plurality of coextensively shaped niches monolithically formed in a top edge of selected ones of the walls. Such niches are equidistantly spaced along the top edges of the selected walls, and the selected walls are located on opposed sides of the base member.

The arena further includes a plurality of depressions monolithically formed in a top edge of selected corner areas of the walls. Each of such depressions is coextensively shaped. The arena further includes a counter rotatably positioned within a top edge of another one of the corner areas of the walls. Such a counter conveniently has a plurality of numbers monolithically formed in an outer surface thereof. Such numbers encircle an outer circumference of the counter such that the user can manually display a desired numbered sequence therewith. The arena further includes a planar mat coextensively shaped with the hollow interior and removably positioned directly thereon such that the mat is interfitted within the hollow interior defined by the base member and the walls respectively. Such a mat has a bottom surface abutted directly against the base member when the mat is interfitted within the hollow interior, and the mat further has a top surface positioned subjacent to the top edge of the walls when the mat is interfitted within the hollow interior. Such a top surface of the mat has surface indicia displayed thereon and further is formed from a deformably resilient material.

The game further includes a mechanism for scoring points. Such a point scoring mechanism is advantageously employed within an interior area of the arena and includes a plurality of pretty dice. Each of such pretty dice has a criss-cross pattern of indicia formed in a selected side thereof and replacing a number five in a traditional die. Each of the pretty dice has a bulls-eye pattern of indicia formed in another side thereof and replacing a number one in a traditional die. Also, each of the pretty dice has numbers two, three, four, and six respectively formed in remaining sides thereof.

The point scoring mechanism further includes a plurality of fancy dice coextensively shaped with the plurality of pretty dice. Selected ones of such fancy dice effectively has a criss-cross pattern of indicia formed in a selected side thereof and replacing a number five in a traditional die. Other ones of the fancy dice have a bulls-eye pattern of indicia formed in a selected side thereof and replacing a number one in a traditional die. Each of the selected fancy dice has the numbers one, two, three, four, and six respectively formed in remaining sides thereof, and each of the other ones of the fancy dice has the numbers two, three, four, five, and six respectively formed in remaining sides thereof.

The point scoring mechanism further includes a third plurality of traditional dice coextensively shaped with the pretty and fancy pluralities of dice respectively and a plurality of big boomer dice with a surface area larger than a surface area of the pretty, fancy, and third pluralities of dice respectively. Each of such big boomer dice conveniently has different indicia monolithically formed in respective selected sides thereof, and each remaining side of each of the big boomer dice has a same pattern of indicia formed thereon.

The point scoring mechanism further includes a dice cup. Such a cup is for housing the pretty, fancy, third, and big boomer dice respectively. The pretty, fancy, third, and big boomer dice respectively are discharged from the cup and into the hollow interior by the user during operating conditions. The pretty, fancy, third, and big boomer dice respectively contact and reside on the top surface of the mat after they are discharged from the cup by the user. Finally the scoring mechanism includes a plurality of chips.

The game apparatus further includes a mechanism for calculating the points. Such a points calculating mechanism advantageously includes a plurality of scoring guides, a marking surface including paper, a marking utensil including a writing implement selected from a group of marking utensils including pencils and pens, and a calculator.

The game apparatus further includes a mechanism for recording the points. Such a recording mechanism is directly connected to the arena and includes a user interface integrally attached to a top edge of other ones of the walls. Each of such user interfaces is effectively located in a medial portion of each of an associated one of the other ones of the walls. The recording mechanism further includes a display screen integrally attached to the top edges of the other ones of the walls. Each of such display screens is located adjacent to the user interfaces. The recording mechanism further includes a processor electrically coupled to the user interface and the display screen respectively and a memory electrically coupled to the processor. Such memory includes software instructions that cause the points scoring mechanism to arithmetically manipulate user points during game play.

The game apparatus further includes a mechanism for advantageously determining how to score the points. Such a score determining mechanism includes a manual of rules. Such a manual describes steps necessary to score points during operating conditions.

A method for providing challenging entertainment for a plurality of users includes the steps of: providing a substantially square-shaped arena; determining how to score points; scoring the points; calculating the points; and recording the points.

The method further includes the steps of: providing a planar base member and providing a plurality of vertical walls monolithically formed with the base member. Such walls are located along an outer perimeter of the base member and extend upwardly and away therefrom such that the base member and the walls respectively cooperate to form a hollow interior defined by the base member and the walls respectively. Each of the walls has an equal height. The steps further include providing a plurality of coextensively shaped niches monolithically formed in a top edge of selected ones of the walls. Such niches are equidistantly spaced along the top edges of the selected walls, and the selected walls are located on opposed sides of the base member.

The steps further include providing a plurality of depressions monolithically formed in a top edge of selected corner areas of the walls. Each of such depressions are coextensively shaped. The steps further include rotatably positioning a counter within a top edge of another one of the corner areas of the walls. Such a counter has a plurality of numbers monolithically formed in an outer surface thereof, and such numbers encircle an outer circumference of the counter.

The steps further include manually displaying a desired numbered sequence with the counter and removably positioning a planar mat within a hollow interior of the arena such that the mat is interfitted within the hollow interior defined by the base member and the walls respectively. Such a mat has a bottom surface abutted directly against the base member when the mat is interfitted within the hollow interior, and the mat has a top surface positioned subjacent to the top edge of the walls when the mat is interfitted within the hollow interior. The steps further include providing surface indicia displayed on the top surface of the mat, and the mat further is formed from a deformably resilient material.

The method further includes the steps of providing a plurality of pretty dice. Each of such pretty dice has a criss-cross pattern of indicia formed in a selected side thereof and replacing a number five in a traditional die. Each of the pretty dice also has a bulls-eye pattern of indicia formed in another side thereof and replacing a number one in a traditional die, and each of the pretty dice has numbers two, three, four, and six respectively formed in remaining sides thereof. The steps further include providing a plurality of fancy dice coextensively shaped with the plurality of pretty dice.

Selected ones of the fancy dice has a criss-cross pattern of indicia formed in a selected side thereof and replacing a number five in a traditional die, and other ones of the fancy dice has a bulls-eye pattern of indicia formed in a selected side thereof and replacing a number one in a traditional die. Each of the selected fancy dice has the numbers one, two, three, four, and six respectively formed in remaining sides thereof, and each of the other ones of the fancy dice has the numbers two, three, four, five, and six respectively formed in remaining sides thereof.

The steps further include providing a third plurality of traditional dice coextensively shaped with the pretty and fancy pluralities of dice respectively and providing a plurality of big boomer dice with a surface area larger than a surface area of the pretty, fancy, and third pluralities of dice respectively. Each of the big boomer dice has different indicia monolithically formed in respective selected sides thereof, and each remaining side of each of the big boomer dice has a same pattern of indicia formed thereon. The steps further include: providing a dice cup; housing the pretty, fancy, third, and big boomer dice respectively in the cup; discharging the pretty, fancy, third, and big boomer dice respectively from the cup and into the hollow interior by the user during operating conditions, the pretty, fancy, third, and big boomer dice respectively contacting and residing on the top surface of the mat after is discharged from the cup by the user; and providing a plurality of chips.

The method further includes the steps of: providing a plurality of scoring guides; providing a marking surface including paper; providing a marking utensil including a writing implement selected from a group of marking utensils including pencils and pens; providing a calculator; and calculating the points.

The method further includes the steps of: integrally attaching a user interface to a top edge of other ones of the walls, each of the user interfaces being located in a medial portion of each of an associated one of the other ones of the walls; integrally attaching a display screen to the top edges of the other ones of the walls, each of the display screens being located adjacent to the user interfaces; electrically coupling a processor to the user interface and the display screen respectively; and electrically coupling a memory to the processor. Such memory includes software instructions that cause the points scoring mechanism to arithmetically manipulate user points during game play.

The method further includes the steps of: providing a manual of rules; describing steps necessary to score points during operating conditions; obtaining an arena; obtaining a plurality of dice; each player rolling the pluralities of dice until a predetermined event occurs; determining whether a player has accumulated a predetermined value of points; if yes, advancing the player to the arena; the player rolling the plurality of dice and removing at least one scoring dice of the plurality of dice; the player continuing to roll the plurality of dice and determining whether a player has rolled a combination of the at least one removed scoring dice; accumulating the player points until the player chooses to stop rolling or rolls a non-scoring dice; determining whether a next player is in the arena and wishes to participate in a boomerang turn; and if yes, the next player rolling the non-scoring dice of the player to record points from scoring dice of the player.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
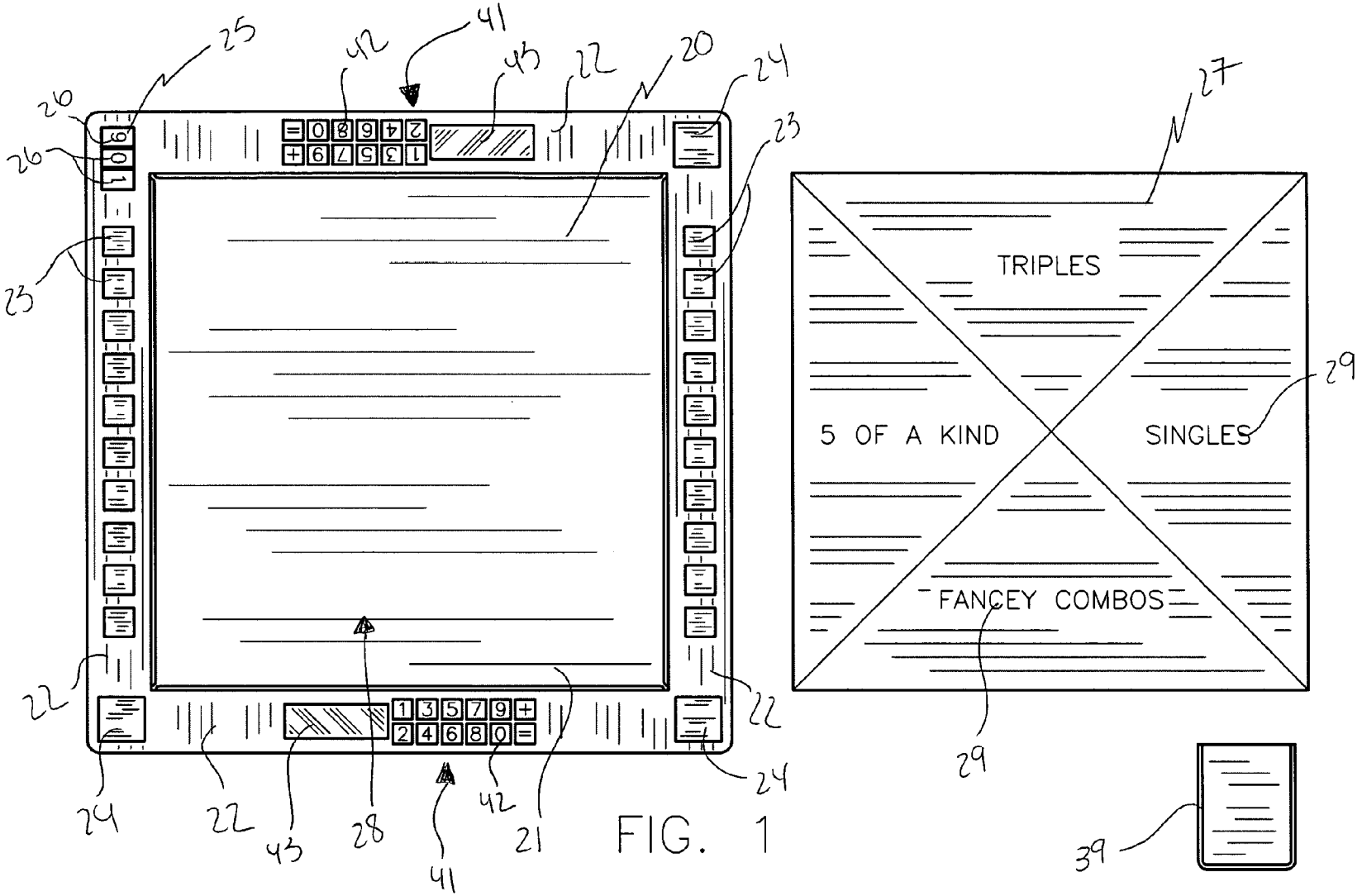
FIG. 1 is a top planar view of the arena and the mat, respectively, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a means for providing challenging entertainment for a plurality of users. It should be understood that the apparatus 10 may be played many different types of ways and should not be limited to those uses mentioned herein.

Figure 2:
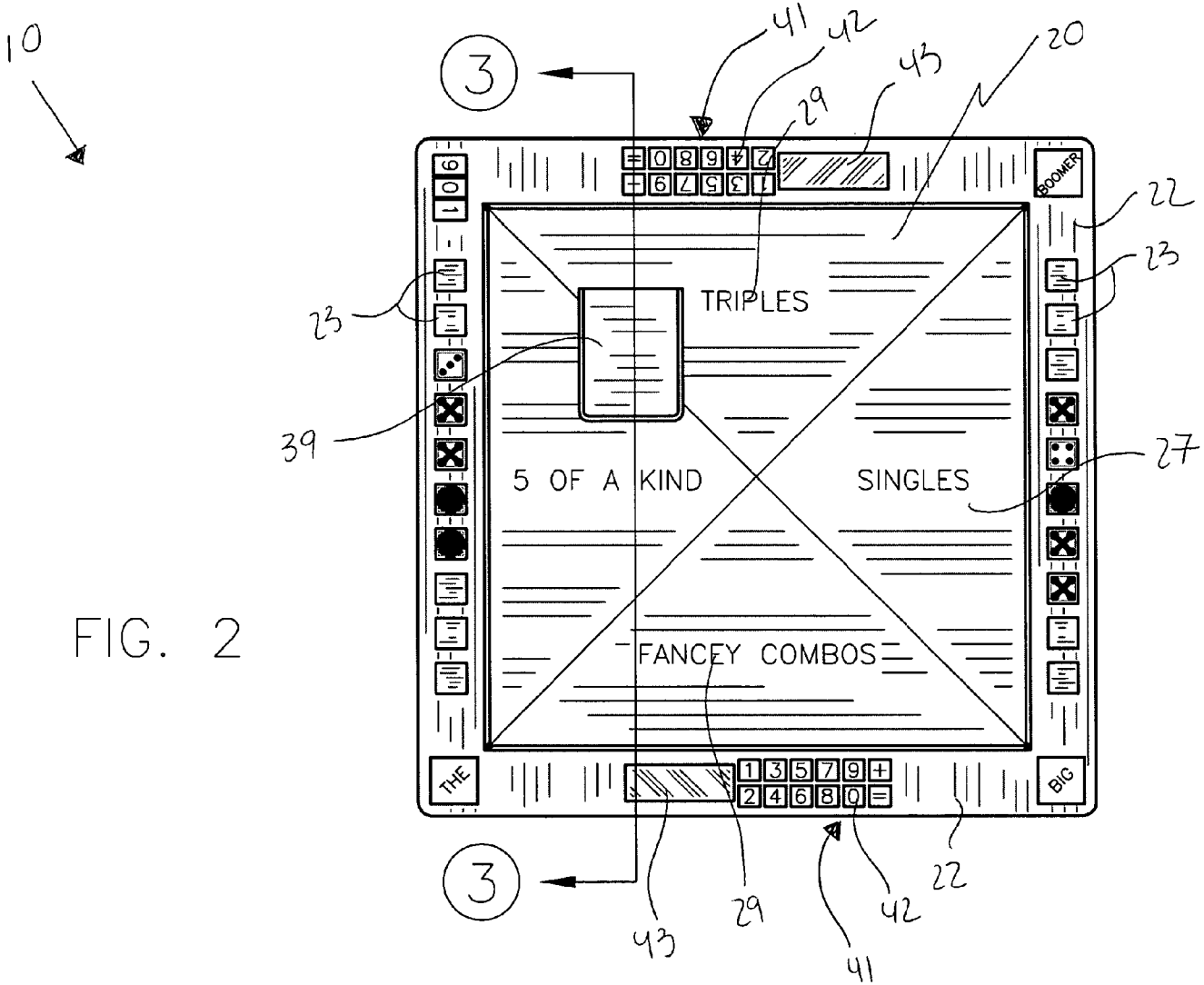
FIG. 2 is a top planar view of the mat fitted within the hollow chamber of the arena, in accordance with the present invention.
Figure 3:
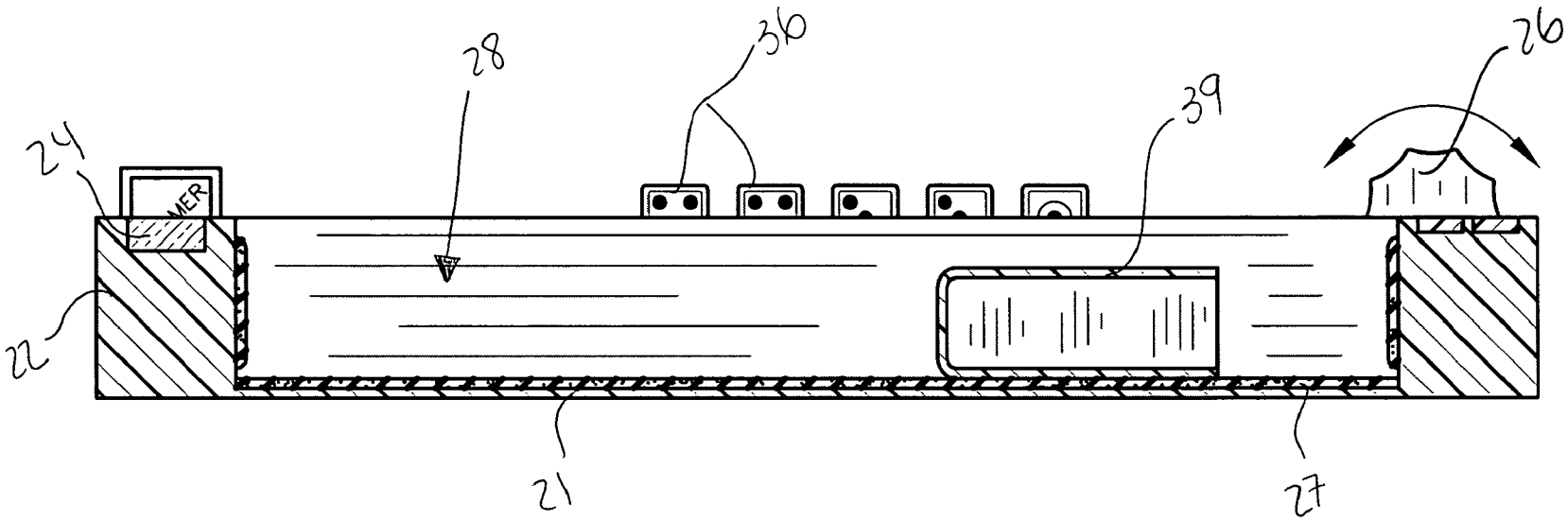
FIG. 3 is a cross sectional view of the arena, taken along line 3-3, in accordance with the present invention.

Referring initially to FIGS. 1, 2 and 3, a combination dice and board game includes a substantially square-shaped arena 20. Such an arena 20 includes a planar base member 21 and a plurality of vertical walls 22 monolithically formed with such a base member 21. Such walls 22 are located along an outer perimeter of the base member 21 and extend upwardly and away therefrom which is essential such that the base member 21 and the walls 22 respectively cooperate to form a hollow interior defined by the base member 21 and the walls 22 respectively. Each of the walls 22 has an equal height. The arena further includes a plurality of coextensively shaped niches 23 monolithically formed in a top edge of selected ones of the walls 22. Such niches 23 are equidistantly spaced along the top edges of the selected walls 22, and the selected walls 22 are located on opposed sides of the base member 21. The walls ensure that the dice will remain on the base member after a player rolls.

The arena further includes a plurality of depressions 24 monolithically formed in a top edge of selected corner areas of the walls 22. Each of such depressions 24 is coextensively shaped. The arena further includes a counter 25 rotatably positioned within a top edge of another one of the corner areas of the walls 22. Such a counter 25 has a plurality of numbers 26 monolithically formed in an outer surface thereof. Such numbers 26 encircle an outer circumference of the counter 25 which is critical such that the user can manually display a desired numbered sequence therewith.

The arena further includes a planar mat 27 coextensively shaped with the hollow interior 28 and removably positioned directly thereon, without the use of intervening characters, which is crucial such that the mat 27 is interfitted within the hollow interior 28 defined by the base member 21 and the walls 22 respectively. Such a mat 27 has a bottom surface abutted directly, without the use of intervening characters, against the base member 21 when the mat 27 is interfitted within the hollow interior 28, and the mat 27 further has a top surface positioned subjacent to the top edge of the walls 22 when the mat 27 is interfitted within the hollow interior. Such a top surface of the mat 27 has surface indicia 29 displayed thereon and further is formed from a deformably resilient material. The counter provides a means for keeping score during a game.

Figure 4:
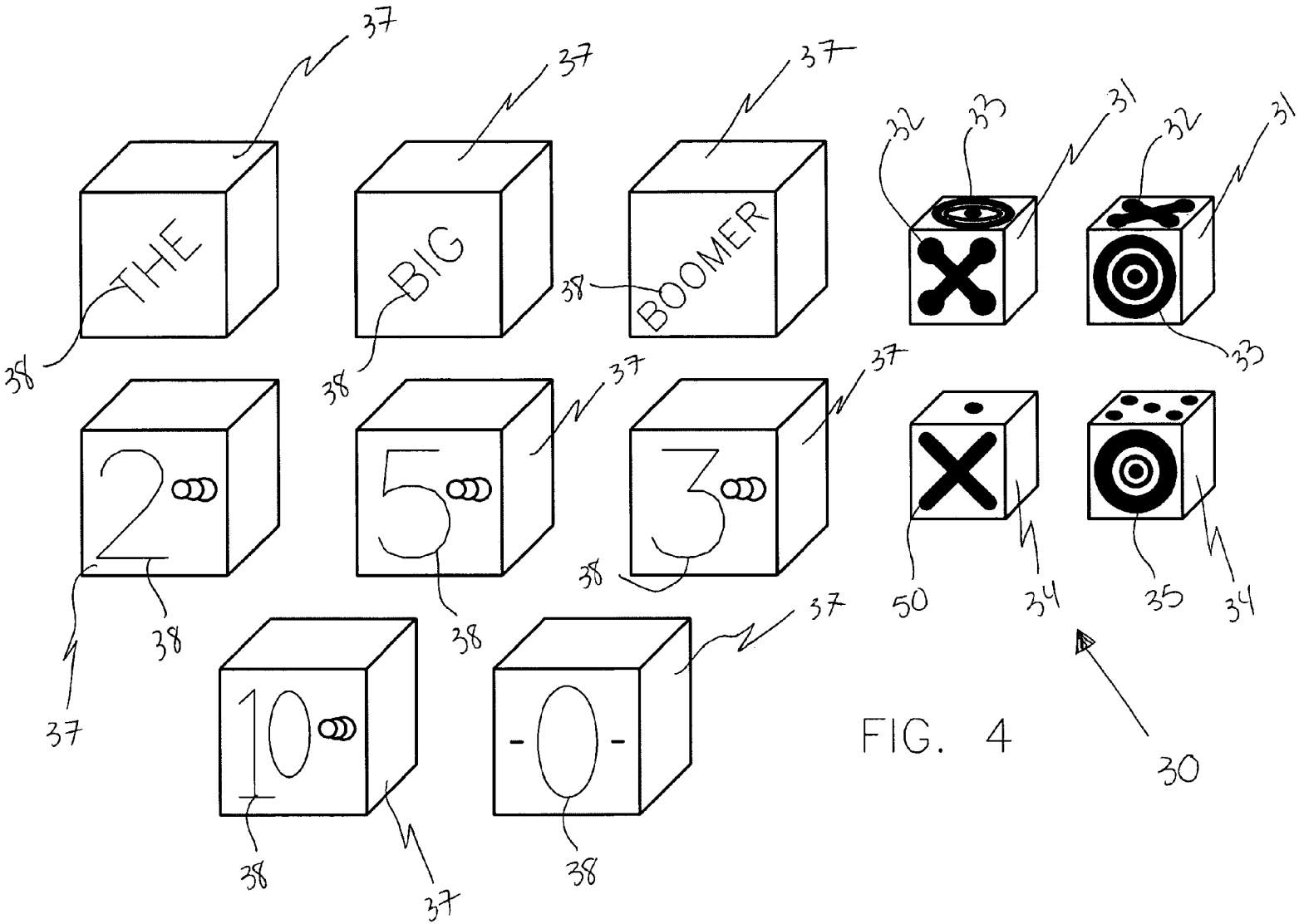
FIG. 4 is a perspective view showing the Pretty, Fancy, and Big Boomer dice, respectively, in accordance with the present invention.

Referring to FIGS. 2, 3 and 4, the game further includes a mechanism for scoring points 30. Such a point scoring mechanism 30 is employed within an interior area of the arena 20 and includes a plurality of pretty dice 31. Each of such pretty dice 31 has a criss-cross pattern of indicia 32 formed in a selected side thereof and replacing a number five in a traditional die. Each of the pretty dice 31 has a bulls-eye pattern of indicia 33 formed in another side thereof and replacing a number one in a traditional die. Also, each of the pretty dice 31 has numbers two, three, four, and six respectively formed in remaining sides thereof.

The point scoring mechanism further includes a plurality of fancy dice 34 coextensively shaped with the plurality of pretty dice 31. Selected ones of such fancy dice 34 has a criss-cross pattern of indicia 50 formed in a selected side thereof and replacing a number five in a traditional die. Other ones of the fancy dice has a bulls-eye pattern of indicia 35 formed in a selected side thereof and replacing a number one in a traditional die. Each of the selected fancy dice 34 has the numbers one, two, three, four, and six respectively formed in remaining sides thereof, and each of the other ones of the fancy dice has the numbers two, three, four, five, and six respectively formed in remaining sides thereof.

The point scoring mechanism further includes a third plurality of traditional dice 36 coextensively shaped with the pretty 31 and fancy 34 pluralities of dice respectively and a plurality of big boomer dice 37 with a surface area larger than a surface area of the pretty, fancy, and third pluralities of dice respectively. Each of such big boomer dice 37 has different indicia 38 monolithically formed in respective selected sides thereof, and each remaining side of each of the big boomer dice has a same pattern of indicia formed thereon. The various dice provide means for scoring points after a player rolls, according to the rules of the game.

The point scoring mechanism further includes a dice cup 39. Such a cup 39 is for housing the pretty, fancy, third, and big boomer dice 31, 34, 36, 37 respectively. The pretty, fancy, third, and big boomer dice respectively are discharged from the cup 39 and into the hollow interior by the user during operating conditions. The pretty, fancy, third, and big boomer dice respectively contact and reside on the top surface of the mat after they are discharged from the cup by the user. Finally the scoring mechanism includes a plurality of chips, not shown, but well understood by one skilled in the art. The dice cup provides a means for simultaneously rolling all ten dice.

The game apparatus further includes a mechanism for calculating the points. Such a points calculating mechanism includes a plurality of scoring guides, a marking surface including paper, a marking utensil including a writing implement selected from a group of marking utensils including pencils and pens, and a calculator. The calculating mechanism allows users to easily keep track of their earned points. While the calculating mechanism is not shown in the figures, the mechanism is well understood by one skilled in the art.

Figure 5:
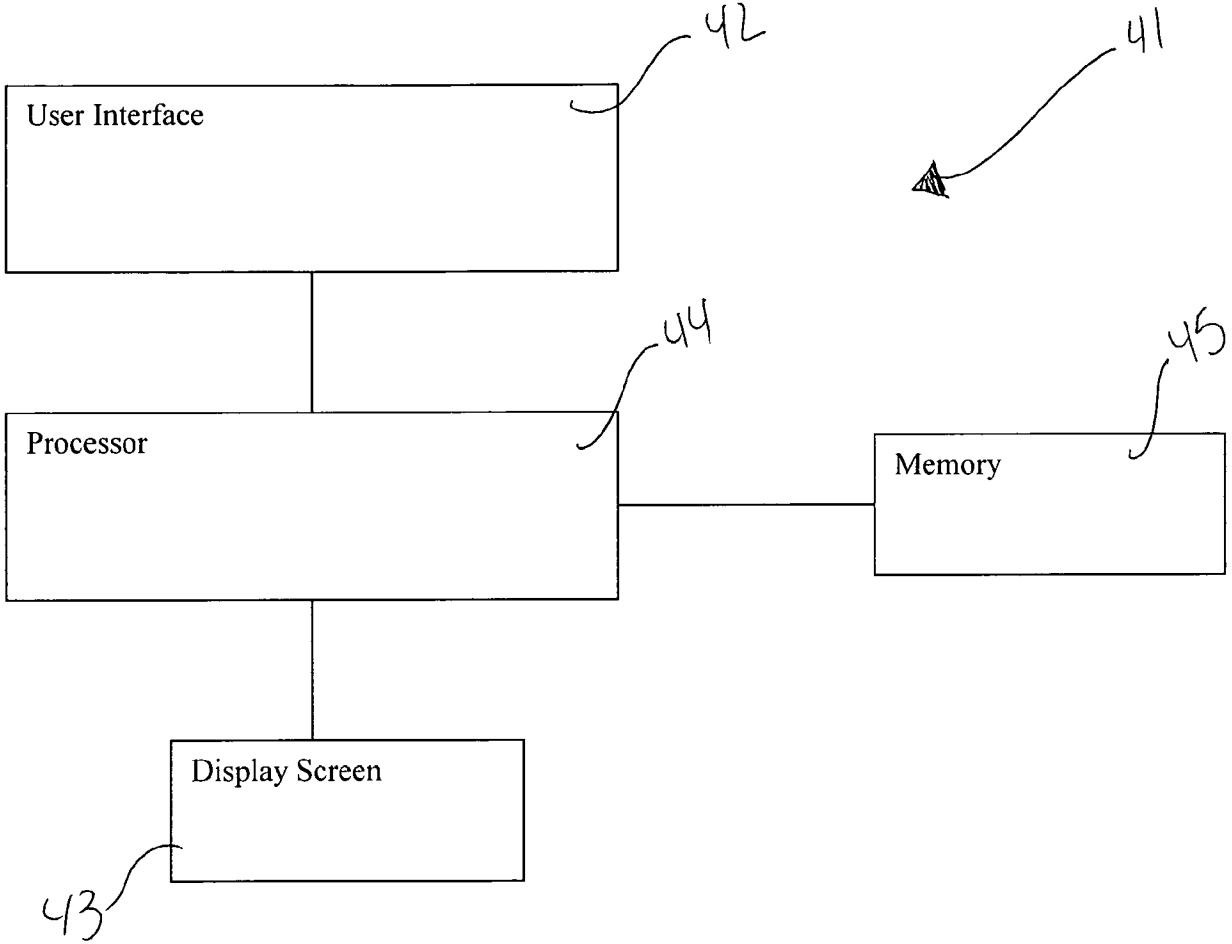
FIG. 5 is a schematic block diagram showing the recording mechanism, in accordance with the present invention.

Referring to FIGS. 1, 2 and 5, the game apparatus further includes a mechanism for recording the points. Such a recording mechanism 41 is directly connected, without the use of intervening characters, to the arena 20 and includes a user interface 42 integrally attached to a top edge of other ones of the walls 22. Each of such user interfaces 42 is located in a medial portion of each of an associated one of the other ones of the walls 22. The recording mechanism further includes a display screen 43 integrally attached to the top edges of the other ones of the walls 22. Each of such display screens 43 is located adjacent to the user interfaces 42.

The recording mechanism further includes a processor 44 electrically coupled to the user interface 42 and the display screen 43 respectively and a memory 45 electrically coupled to the processor 44. Such memory 45 includes software instructions that cause the points scoring mechanism to arithmetically manipulate user points during game play, as well known by one skilled in the art. The software instructions can be written in a variety of well-known computer program languages such as C++, Fortran, Pascal, etc. The point recording mechanism allows each user to track points accumulated during the game and thereby compare their point values with those of the other players.

The game apparatus further includes a mechanism for determining how to score the points. Such a score determining mechanism includes a manual of rules. Such a manual describes steps necessary to score points during operating conditions. The manual of rules ensures that each user can fully understand how to play the game with strategic advantage. While the manual is not shown in the figures, see description herein below for manual content. The game finally includes a pouch for storing and transporting all components of the game.

Figure 6:
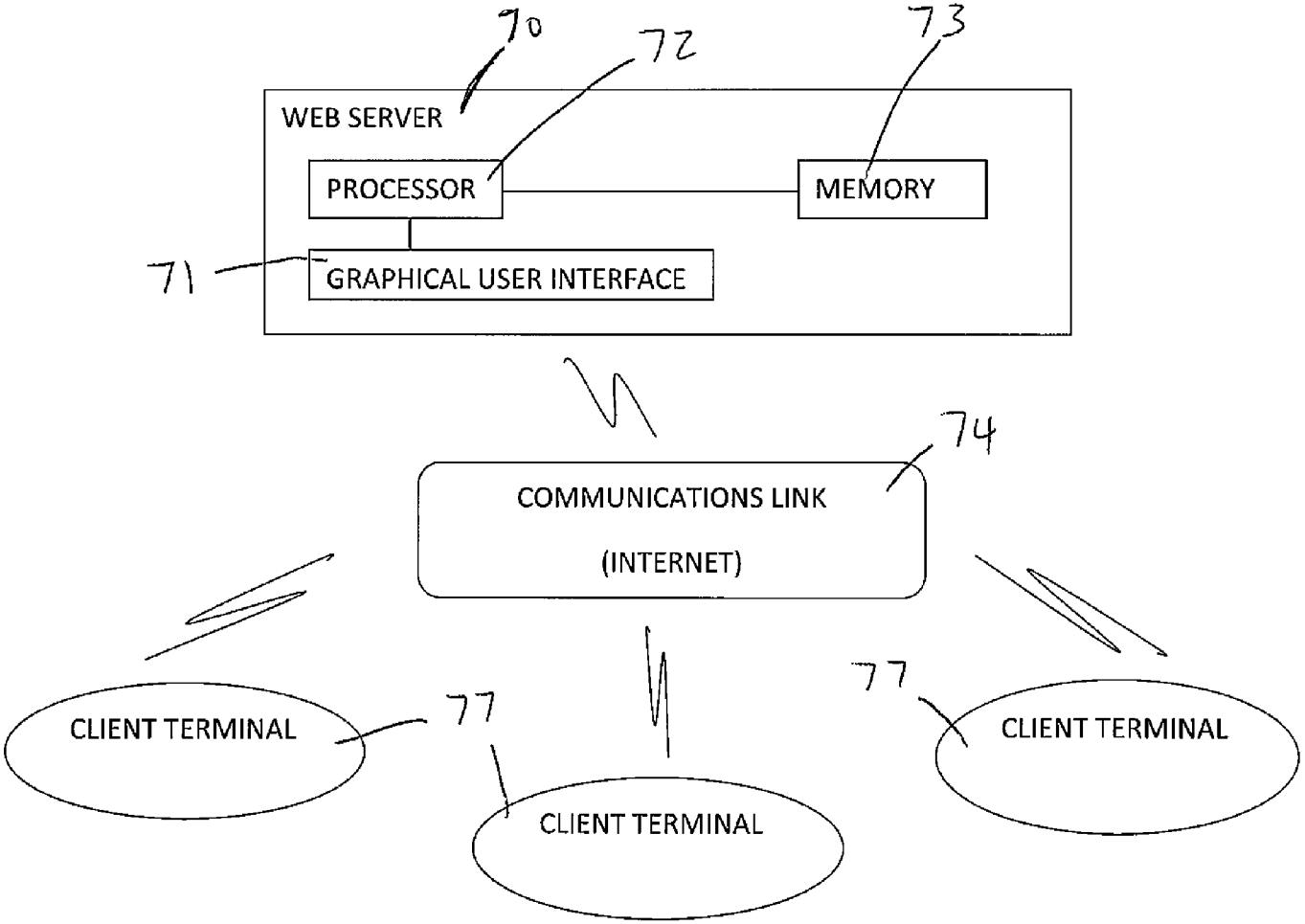
FIG. 6 is high-level schematic block diagram showing the interrelationship between the major electronic components of the computer-implemented board game that is played online, via the internet, in accordance with a non-limiting exemplary embodiment of the present invention.

Referring to FIG. 6, in a non-limiting exemplary embodiment of the present invention, a computer-implemented software program preferably allows multiple players to play the board game 10 via the internet in an online format. For example, a web server 70 may host a website that provides a graphical user interface 71. Each player interacts with the web server 70 via the graphical user interface 71. The web server 70 may include a processor 72 and a memory 73 communicatively coupled thereto. A plurality of client terminals 73 are communicatively coupled to the web server 70 via a communications link 74, such as the internet. Memory 73 preferably includes a computer software program including computer software instructions, when executed by the processor 72, which allows the players to play the board game online. Such computer software instructions preferably includes and executes a control logic algorithm that includes a plurality of chronological steps, as explained hereinbelow.

For example, the computer software instructions may include and execute a control logic algorithm preferably including the chronological steps of: determining whether each of the players rolls a minimum point total in one turn without busting; after each of the players rolls all ten dice, removing at least one scoring dice; and grouping combined ones of the scoring dice together and grouping single ones of the scoring dice together for scoring purposes.

The control logic algorithm may further include the chronological steps of: confirming one of the players has one dice left and chooses to roll an all score; enabling the one player to call $1^{st}$, $2^{nd}$, or $3^{rd}$ roll before rolling the dice, as a scoring roll of the one player; if all ten dice score for the one player, the one player picking up all ten dice and continuing to play as a same turn; if the one player rolls a fancy combo, when the one player busts, automatically granting a bonus turn and a predetermined point value to a total score of the one player; instructing the one player to pick up all ten dice and roll again; and after a bonus turn, enabling the one player to roll with a risk of busting, unless another fancy combo is rolled.

The control logic algorithm may further include the step of: ending the turn of the one player when the one player fails to roll any scoring dice or the one player chooses to stop the turn and record the total score.

The control logic algorithm may further include the chronological steps of: if the one player chooses to stop rolling and records the total score and a next one of the players is on the board, advising the next player of an option to either start a normal turn with the ten dice or call boomerang; instructing the next player to roll the non-scoring dice of the one player; if no scoring dice are rolled by the next player, instructing the next player to turn over the no scoring dice to the one player; and if a scoring dice is rolled by the next player, adding points from the one player to points of the next player.

The control logic algorithm may further include the step of: stopping boomerang when one of the one player and the next player busts.

The control logic algorithm may further include the step of: stopping boomerang when one of the one player and the next player stops an all score turn thereby preventing another player from calling boomerang.

The control logic algorithm may further include the step of: stopping boomerang when one of the one player and the next player goes to a big boomer arena.

In a non-limiting exemplary embodiment, to begin playing the game, each player first rolls one dice to see who goes first. The highest scoring roll becomes the first player. To get "on board," a player must roll at least 2500 points in one turn without busting. Once a player is on the board, a player stays on the board even if their points go to zero. The advantage of being on the board is being able to "Boomerang" the previous player.

A player rolls all ten dice, and then removes at least one scoring dice. If one dice rolls off the playing surface, that die is rolled again. If more than one die leaves the playing surface, the player picks up all of the dice in that roll and rolls again. The player may choose to remove (put aside, with value showing) any or all dice, in singles or combination, in order to accumulate points. When removing scoring dice, combinations must stay together and single dice must stay separate for scoring purposes.

If a player has one die left and chooses to roll for an "All Score," the player may call $1^{st}$, $2^{nd}$, or $3^{rd}$ roll before the die lands, as his scoring roll. If all ten dice score, this is called an "All Score" and the player may pick up all ten dice and continue to play as the same turn. If a player rolls a "Fancy" combo, when the player busts, he is automatically granted a bonus turn and given 1000 points to his total score. The player then picks up all ten dice and rolls again. After a bonus turn, a player rolls with risk of busting, unless another Fancy combo is rolled.

The player's turn is over when he fails to roll any scoring dice or he chooses to stop his turn and record his score. A player should record his score at the end of the turn, not as the dice are rolled.

If a player chooses to stop rolling and records his score, the next player has the option to either start his normal turn with ten dice or the player may call "Boomerang." That player must already be on the board. The player then rolls the previous player's remaining non-scoring dice, trying to roll any scoring dice. If no scoring dice are rolled, turn it over. If a scoring die or dice is rolled, the player adds the points from the previous player's recorded score to his own. The player may continue to roll with risk of busting, or stop and record score. The next player has the option of calling "Boomerang" if he chooses to continue to play off the original and previous player's score.

"Boomerang" stops when a player busts, stops his turn on an "All Score," (preventing the next player from calling Boomerang) or goes to the "Big Boomer Arena." A player cannot Boomerang off of a "Baby Boomer" turn. A player cannot go to the Big Boomer Arena off of a Boomerang. A player also cannot Boomerang when the previous player loses his turn by a penalty.

If a player rolls 25,000 points in one turn without busting, the player may then move to the Big Boomer Arena. The player can only use points he has accumulated by rolling the dice. A player may use points received from a Baby Boomer to go to the Big Boomer Arena but cannot use points from Boomerang to go to the Big Boomer Arena. The player picks up the three Boomer dice and rolls. The player has the option to call the $1^{st}$, $2^{nd}$, or $3^{rd}$ roll as his scoring roll, before the dice lands. If the player rolls the Big Boomer with the three dice, he automatically wins the game.

When keeping score, the player opposite or next to the player will count the player's points, the player's available and used bonus turns, and record the player's score during each turn. This gives the roller an opportunity to roll without stopping. Everyone playing should be aware of each person's score. A player may choose to have one Master Scorekeeper to add each player's scores. A player's score should be recorded at the end of the turn, not as point are accumulated or subtracted.

When a player earns a bonus turn, a "bonus chip" is given to the player. When he uses his bonus turn after busting, the chip is then returned to the bank. Another player may keep track of the bonus chips. Bonus chips may only be used within the turn that they are earned.

There are many strategies a player can use to accumulate more points and beat his opponents. Pulling out or removing all scoring dice may not be the optimal move. A player may want to keep more dice available to roll, as that gives a player more possibilities to roll combinations. Knowing which dice yield the highest score will help a player win the game.

Always pull out three 1's as they are worth 1000 points. Three fancy 1's are worth 1000 points plus a bonus turn. Three pretty 1's are worth 2000 plus a bonus turn. Taking the chance to roll an "All Score" over busting allows a player to pick up all ten dice and continue his next turn or stop his turn. This takes the Boomerang option away from the next player. A player may also stop with an "All Score" without risking loss of points and removing the opportunity for his opponent to Boomerang.

A player may use any combination of the dice to get the highest score. If a player rolls seven of a kind, he can use the points of a five of a kind. If a player rolls an eight of a kind, he may use the points of a five of a kind, then the remaining three for a three of a kind. This does not apply to rolling six of a kind.

The Big Boomer is a game of challenge, strategy, risk, reward and fun. The game may be played with two to eight individual players or in teams. Each team may choose how they would like to roll, whether they share rolling within one turn, or choose to roll alternately. The object of the game is to accumulate the predetermined number of points before their opponent or opponents. A standard game is 100,000 points.

A "Turn" is continually rolling and scoring the dice until dice are rolled with no score (busting), or a player chooses to stop or "Stick." A "Bonus Turn" gives a player an additional 1000 points and allows a player to continue to roll after rolling non-scoring dice. A Bonus Turn is earned after rolling "Fancy" or "Pretty" combos. A "Risk-free" turn is earned when rolling in the "Big Boomer" arena without the risk of busting.

"Fancies" and "Pretties" are specially marked dice with added value in combinations. Pretties are Fancies, but Fancies are not Pretties. An "All Score" is when all ten dice score points within a turn. A player may continue to pick up all dice and roll again until he chooses to stop, bust, or roll "All Score" again. A "Baby Boomer" means rolling a certain combination of the remaining 8 out of 10 dice on the board. A "Boomerang" is an opportunity to add the previous player's score to the current player by rolling his remaining non-scoring dice. A player must score on his first attempt to receive points. A "Sack" occurs when a layer reaches 100,000 points with no one else on board. In a tournament or multiple game play, this gives the "Sacker" an automatic two-game win.

There are ten playing dice and three additional dice showing the Big Boomer. The Big Boomer dice are used only when entering the 'arena' and with a Baby Boomer. There are three Big Boomer dice. Each of them has a word "The," "Big," or "Boomer" on one side of the dice. The other sides are color coded and have different values. "The"=20,000 plus a risk free turn. "Big"=20,000 plus a risk free turn. "Boomer"=20,000 plus a risk free turn. The other sides of the Big Boomer dice are colored with clearly marked values: Zero, 2000, 3000, 5000, and 10000.

There are three dice that have "Fancy" ones or three "Circled Ones." There are four dice that have "Fancy" fives or four "X'd Fives." There are three dice that have "Pretty Fancy" 1's, also know as "Pretty Boys," and "Pretty Fancy" 5's or "Pretty Girls" are with additional colors.

Dice Values and Scoring:

One 1=100

One 5=50

Combinations:

Three 1's=1000

Three 5's=500

Three 2's=200

Three 3's=300

Three 4's=400

Three 6's=600

Five of any number=face value of one die×1000

Five 1's which includes 3 "Fancy" 1's=10000 plus a bonus turn

Six of any dice is a penalty. Pretty/Fancy combinations are the exception and if rolled prior to the 6-kind, in that turn, nullify the penalty (meaning the 6-kind would now be a 5-kind plus 1).

The Fancy Dice:

Three Fancy 1's=1000 plus a bonus turn

Three Pretty 1's=2000 plus a bonus turn

Three Fancy 1's plus 2 plain 1's=10000 plus a bonus turn

Four Fancy 1's=20000 plus a bonus turns

Five Fancy 1's=20000 plus two bonus turns

Six Fancy 1's=30000 plus three bonus turns

Four Fancy 5's=5000 plus a bonus turn

Five fancy 5's=10000 plus a bonus turn

Six Fancy 5's=20000 plus two bonus turns

Seven Fancy 5's=30000 plus three bonus turns

Three Pretty and Fancy fives are not a Pretty/Fancy combination.

Anytime three Pretty 5's are rolled, 5000 points are awarded to all other players on the board. These points are not subtracted from the rolling player. The player may use the Pretty fives in any way he wishes to add to his score. Any player reaching 100000 from this move wins the game.

A Baby Boomer is left with the remaining eight dice. Rolling two 2's, two 3's, two 4's, and two 6's rolled at the same time, allows a player to pick up one of the Big Boomer dice and roll. If player rolls a word, he adds 20000 points, gets a risk free turn with all playing dice and adds these points to his total turn. A player may continue rolling with the risk of busting and losing all these points. He can go to the Big Boomer arena with points accumulated from a Baby Boomer only if all the points are from his turn. The player may not Boomerang off of a Baby Boomer turn. Note also that the player must have pulled out two scoring dice before rolling a Baby Boomer. Eight non-scoring dice determines that a player has a Baby Boomer.

Six of a kind gets multiplied by 1000 and is subtracted from a player's score. Any other points scored within that turn are now negative and must also be subtracted. The player's turn is then over. However, an exemption occurs when rolling Pretty or Fancy combinations. If a player has rolled Pretty or Fancy combinations in his turn or if they are a part of a six of a kind, the player is exempt from the penalty and continues to score. If a player Boomerangs and rolls a 6-kind without having rolled a Pretty/Fancy combo first, his turn is over and all points are subtracted. If a penalty is greater than what a player has on his score, that player's score only goes to zero and the player remains "on the board."

"The" plus "Big" plus "Boomer"=instant win, game, match or tournament. "The," "Big," or "Boomer"=20000 per word and other die value that is clearly marked on each side. Plus a risk free turn is scored with the ten competition dice, per word. Rolling all the same color of Boomer dice=total points plus a risk free turn with the 10 regular competition dice.

The combination dice and board game provides the unexpected benefit of challenging users in an entertaining manner. In addition, users learn to think strategically and competitively. The point calculating mechanism ensures that point values are accurate without disturbing the flow of the game. Such benefits overcome the prior art shortcomings.

In use, a method for providing challenging entertainment for a plurality of users includes the steps of: providing a substantially square-shaped arena 20; determining how to score points; scoring the points; calculating the points; and recording the points.

In use, the method further includes the steps of: providing a planar base member 21 and providing a plurality of vertical walls 22 monolithically formed with the base member 21. Such walls 22 are located along an outer perimeter of the base member 21 and extend upwardly and away therefrom such that the base member 21 and the walls 22 respectively cooperate to form a hollow interior 28 defined by the base member 21 and the walls 22 respectively. Each of the walls 22 has an equal height. The steps further include providing a plurality of coextensively shaped niches 23 monolithically formed in a top edge of selected ones of the walls 22. Such niches 23 are equidistantly spaced along the top edges of the selected walls 22, and the selected walls 22 are located on opposed sides of the base member 21.

The steps further include providing a plurality of depressions 24 monolithically formed in a top edge of selected corner areas of the walls 22. Each of such depressions 24 are coextensively shaped. The steps further include rotatably positioning a counter 25 within a top edge of another one of the corner areas of the walls 22. Such a counter 25 has a plurality of numbers 26 monolithically formed in an outer surface thereof, and such numbers 26 encircle an outer circumference of the counter 25. The steps further include manually displaying a desired numbered sequence with the counter 25 and removably positioning a planar mat 27 within a hollow interior 28 of the arena 20 such that the mat 27 is interfitted within the hollow interior 28 defined by the base member 21 and the walls 22 respectively. Such a mat 27 has a bottom surface abutted directly against, without the use of intervening characters, the base member 21 when the mat 27 is interfitted within the hollow interior 28, and the mat 27 has a top surface positioned subjacent to the top edge of the walls 22 when the mat 27 is interfitted within the hollow interior 28. The steps further include providing surface indicia 29 displayed on the top surface of the mat 27, and the mat 27 further is formed from a deformably resilient material.

In use, the method further includes the steps of providing a plurality of pretty dice 31. Each of such pretty dice 31 has a criss-cross pattern of indicia 32 formed in a selected side thereof and replacing a number five in a traditional die. Each of the pretty dice 31 also has a bulls-eye pattern of indicia 33 formed in another side thereof and replacing a number one in a traditional die, and each of the pretty dice has numbers two, three, four, and six respectively formed in remaining sides thereof. The steps further include providing a plurality of fancy dice 34 coextensively shaped with the plurality of pretty dice 31. Selected ones of the fancy dice 34 has a criss-cross pattern of indicia 50 formed in a selected side thereof and replacing a number five in a traditional die, and other ones of the fancy dice 34 has a bulls-eye pattern of indicia 35 formed in a selected side thereof and replacing a number one in a traditional die. Each of the selected fancy dice 34 has the numbers one, two, three, four, and six respectively formed in remaining sides thereof, and each of the other ones of the fancy dice 34 has the numbers two, three, four, five, and six respectively formed in remaining sides thereof.

The steps further include providing a third plurality of traditional dice 36 coextensively shaped with the pretty 31 and fancy 34 pluralities of dice respectively and providing a plurality of big boomer dice 37 with a surface area larger than a surface area of the pretty, fancy, and third pluralities of dice respectively. Each of the big boomer dice 37 has different indicia 38 monolithically formed in respective selected sides thereof, and each remaining side of each of the big boomer dice 37 has a same pattern of indicia formed thereon. The steps further include: providing a dice cup 39; housing the pretty, fancy, third, and big boomer dice respectively in the cup 39; discharging the pretty, fancy, third, and big boomer dice respectively from the cup 39 and into the hollow interior 38 by the user during operating conditions, the pretty, fancy, third, and big boomer dice respectively contacting and residing on the top surface of the mat 37 after is discharged from the cup 39 by the user; and providing a plurality of chips.

In use, the method further includes the steps of: providing a plurality of scoring guides; providing a marking surface including paper; providing a marking utensil including a writing implement selected from a group of marking utensils including pencils and pens; providing a calculator; and calculating the points.

In use, the method further includes the steps of: integrally attaching a user interface 42 to a top edge of other ones of the walls 22, each of the user interfaces 42 being located in a medial portion of each of an associated one of the other ones of the walls 22; integrally attaching a display screen 43 to the top edges of the other ones of the walls 22, each of the display screens 43 being located adjacent to the user interfaces 42; electrically coupling a processor 44 to the user interface 42 and the display screen 43 respectively; and electrically coupling a memory 45 to the processor 44. Such memory 45 includes software instructions that cause the points scoring mechanism to arithmetically manipulate user points during game play.

In use, the method further includes the steps of: providing a manual of rules; describing steps necessary to score points during operating conditions; obtaining an arena 20; obtaining a plurality of dice; each player rolling the pluralities of dice until a predetermined event occurs; determining whether a player has accumulated a predetermined value of points; if yes, advancing the player to the arena 20; the player rolling the plurality of dice and removing at least one scoring dice of the plurality of dice; the player continuing to roll the plurality of dice and determining whether a player has rolled a combination of the at least one removed scoring dice; accumulating the player points until the player chooses to stop rolling or rolls a non-scoring dice; determining whether a next player is in the arena and wishes to participate in a boomerang turn; and if yes, the next player rolling the non-scoring dice of the player to record points from scoring dice of the player.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A computer implemented board game system for enabling a plurality of players to simultaneously play a board game online, said computer implemented board game system comprising:

a web server including a processor and memory communicatively coupled thereto;

a communications link;

a plurality of client terminals communicatively coupled to said web server via said communications link;

wherein said memory includes computer software instructions, when executed by said processor, allowing said players to play said board game online;

wherein said computer software instructions include and execute a control logic algorithm including the chronological steps of:

determining whether each of said players rolls a minimum point total in one turn without busting;

after each of said players rolls all ten dice, removing at least one scoring dice; and grouping combined ones of said scoring dice together and grouping single ones of said scoring dice together for scoring purposes;

wherein said control logic algorithm further includes the chronological steps of:

confirming one of said players has one dice left and chooses to roll an all score;

enabling said one player to call $1^{st}$, $2^{nd}$, or $3^{rd}$ roll before rolling the dice, as a scoring roll of said one player;

if all ten dice score for said one player, said one player picking up all ten dice and continuing to play as a same turn;

if said one player rolls a fancy combo, when said one player busts, automatically granting a bonus turn and a predetermined point value to a total score of said one player;

instructing said one player to pick up all ten dice and roll again; and after a bonus turn, enabling said one player to roll with a risk of busting, unless another fancy combo is rolled.

2. The computer implemented board game system of claim 1, wherein said control logic algorithm further includes the step of:

ending the turn of said one player when said one player fails to roll any scoring dice or said one player chooses to stop the turn and record the total score.

3. The computer implemented board game system of claim 2, wherein said control logic algorithm further includes the chronological steps of:

if said one player chooses to stop rolling and records the total score and a next one of said players is on the board, advising said next player of an option to either start a normal turn with the ten dice or call boomerang;

instructing said next player to roll the non-scoring dice of said one player;

if no scoring dice are rolled by said next player, instructing said next player to turn over the no scoring dice to said one player; and if a scoring dice is rolled by said next player, adding points from said one player to points of said next player.

4. The computer implemented board game system of claim 3, wherein said control logic algorithm further includes the step of: stopping boomerang when one of said one player and said next player busts.

5. The computer implemented board game system of claim 3, wherein said control logic algorithm further includes the step of: stopping boomerang when one of said one player and said next player stops an all score turn thereby preventing another player from calling boomerang.

6. The computer implemented board game system of claim 3, wherein said control logic algorithm further includes the step of: stopping boomerang when one of said one player and said next player goes to a big boomer arena.

7. A non-transitory medium comprising computer software instructions to be executed by a processor, allowing a plurality of players to play a board game online, said computer software instructions including and executing a control logic algorithm including the chronological steps of:

determining whether each of said players rolls a minimum point total in one turn without busting;

after each of said players rolls all ten dice, removing at least one scoring dice; and grouping combined ones of said scoring dice together and grouping single ones of said scoring dice together for scoring purposes;

wherein said control logic algorithm further includes the chronological steps of:

confirming one of said players has one dice left and chooses to roll an all score;

enabling said one player to call $1^{st}$, $2^{nd}$, or $3^{rd}$ roll before rolling the dice, as a scoring roll of said one player;

if all ten dice score for said one player, said one player picking up all ten dice and continuing to play as a same turn;

if said one player rolls a fancy combo, when said one player busts, automatically granting a bonus turn and a predetermined point value to a total score of said one player;

instructing said one player to pick up all ten dice and roll again; and after a bonus turn, enabling said one player to roll with a risk of busting, unless another fancy combo is rolled.

8. The non-transitory medium of claim 7, wherein said control logic algorithm further includes the step of:

ending the turn of said one player when said one player fails to roll any scoring dice or said one player chooses to stop the turn and record the total score.

9. The computer implemented board game system of claim 8, wherein said control logic algorithm further includes the chronological steps of:

if said one player chooses to stop rolling and records the total score and a next one of said players is on the board, advising said next player of an option to either start a normal turn with the ten dice or call boomerang;

instructing said next player to roll the non-scoring dice of said one player;

if no scoring dice are rolled by said next player, instructing said next player to turn over the no scoring dice to said one player; and if a scoring dice is rolled by said next player, adding points from said one player to points of said next player.

10. The computer implemented board game system of claim 9, wherein said control logic algorithm further includes the step of: stopping boomerang when one of said one player and said next player busts.

11. The computer implemented board game system of claim 9, wherein said control logic algorithm further includes the step of: stopping boomerang when one of said one player and said next player stops an all score turn thereby preventing another player from calling boomerang.

12. The computer implemented board game system of claim 9, wherein said control logic algorithm further includes the step of: stopping boomerang when one of said one player and said next player goes to a big boomer arena.

* * * * *